United States Patent [19]

Bergstrom

[11] 3,948,181

[45] Apr. 6, 1976

[54] SHAPED CHARGE

[75] Inventor: John J. Bergstrom, Cedar Falls, Iowa

[73] Assignee: Chamberlain Manufacturing Corporation, Waterloo, Iowa

[22] Filed: May 14, 1973

[21] Appl. No.: 365,823

[52] U.S. Cl. ..... 102/56 SC; 102/24 HC; 102/90

[51] Int. Cl.[2] ..... F42B 13/10

[58] Field of Search ..... 102/24 HC, 56, 90

[56] References Cited

UNITED STATES PATENTS

| | | | |
|---|---|---|---|
| 2,809,585 | 10/1957 | Moses | 102/24 HC |
| 2,927,535 | 3/1960 | Abramson et al. | 102/56 |
| 3,235,005 | 2/1966 | Delacour | 102/24 HC |
| 3,669,020 | 6/1972 | Waite et al. | 102/90 |

FOREIGN PATENTS OR APPLICATIONS

| | | | |
|---|---|---|---|
| A73,306 | 6/1960 | France | 102/24 HC |
| 90,800 | 11/1957 | Norway | 102/24 HC |
| 624,117 | 7/1961 | Canada | 102/24 HC |
| 864,238 | 3/1961 | United Kingdom | 102/24 HC |

*Primary Examiner*—Verlin R. Pendegrass
*Attorney, Agent, or Firm*—Hill, Gross, Simpson, Van Santen, Steadman, Chiara & Simpson

[57] ABSTRACT

Method and apparatus for improving the behind-the-targets effects of shaped charge munitions which provides a secondary target defeating mechanism which follows through the opening formed by the high velocity jet which perforates the target. The shaped charge liner may be axially symmetrical in the form of a cone or section of a sphere and behind the apex is mounted the follow through secondary target defeating mechanism which is surrounded by the explosive charge. When the charge is ignited the resulting detonation wave collapses the liner into a high velocity jet or slug that perforates the target after which the follow-through agent is driven through the perforation. The follow-through agent may be pyrophoric or ignitable and such agents will increase the temperature and pressure particularly if the target is a closed target. Other materials may be used and introduced into the target through the perforation.

3 Claims, 12 Drawing Figures

SHAPED CHARGE

BACKGROUND OF THE INVENTION

1. Field of the Invention

This invention relates in general to munitions and in particular to shaped charge follow-through devices.

2. Description of the Prior Art

The destruction of hard targets such as tanks long has been a major problem of explosive ordnance. Shaped charge technology has been developed to the point where the ability of a conical shaped charge to perforate a certain thickness of armor can be predicted with accuracy. It is known, however, that the perforation of protective armor may not be sufficient to comprise target defeat. For example, to defeat a tank or other armored vehicle sufficient damage must be inflicted to prevent successful vehicle operation and although prior art shaped charge technology may result in some damage resulting from fragmentation or spallation, sufficient personnel may survive to continue operation of the tank or other armored vehicle. The increased pressure within the target may cause damage to both personnel and material, and catastrophic kills can result if energy stored within the target such as fuel or ammunition is ignited.

Incendiary fragments have been mounted adjacent to the shaped charge liner wherein the incendiary fragments are attached to the surface of a liner and extend from the apex of the liner to the outer surface of the case such that incendiary fragments follow the jet and enter the target to provide the desired incendiary effect. Limited tests utilizing this technique show that only about 29 percent of the incendiary fragments penetrate the target and produce effective incendiary action. Such structure does not appear to be as efficient or effective as desired.

Another relatively simple approach of the prior art comprises incorporating incendiary material as a layer attached to the shaped charge liner so that it will be between the penetrating portion of the liner and the explosion. An incendiary used must be inert and one which is compatible with both the liner and the explosive. The incendiary must be machineable or easily worked in some manner to permit the fabrication of a precision liner that will not degrade shaped charge penetration. In practice it has been difficult to maintain tolerances of the primary liner and the incendiary liner for maximum effectiveness. A secondary problem exists where certain incendiary materials when fired into closed spaces which have insufficient oxygen are extinguished before being consumed. Oxygen depletion is an effective anti-personnel lethal mechanism but greater anti-material effectiveness can be obtained if the incendiary burns until consumed.

Yet another approach of the prior art is to provide an integral liner with a forward annular oxidizer wherein a forward annular compartment contains an oxidizer such as ammonium nitrate forward of the shaped charge liner to provide an oxygen atmosphere within the target. The annular chamber is dimensioned and positioned so that the oxidizer will be projected into the target by the aspiration effect of the jet while allowing unrestricted formation and travel of the jet. The use of a forward annular oxidizer with an integral liner with copper-aluminum and copper-magnesium and using ammonium nitrate as the forward annular oxidizer has successfully operated.

It has been known to replace the oxidizer of the forward annular oxidizer structure with a forward annular incendiary placed ahead of a simple liner. Tests utilizing this concept showed a 10 percent to 15 percent decrease in penetration.

SUMMARY OF THE INVENTION

The present invention comprises a method and apparatus for introducing large quantities of materials into targets which have been perforated by shaped charge warheads. The objective of delivering the secondary material into the target is to enhance the damage through added incendiary capability and to increase the pressure and temperature effects within the target or to otherwise modify the environment such as by adding CS gas. In the present invention the incendiary material is located within the explosive charge behind the apex of the conical liner and is located on the shaped charge axis of symmetry. The detonation wave originating on the shaped charge axis and to the rear of the follow-through incendiary material progresses around the material and collapses the shaped charge liner in a conventional manner. The high energy jet thus formed, produced by a collapse of the liner, perforates the target and the liner slug follows the jet through the hole which has been formed. The incendiary material then follows the slug of the liner at a lower velocity and enters the target. If the material is pyrophoric (such as misch metal), it will be ignited by the deformation it experiences on explosive charge functioning and a "stream" of burning particles will enter the target. Material such as aluminum powder combusts rapidly upon being dispersed and combined with oxygen behind the armor of the target. The secondary kill mechanism of this invention may comprise a cylindrical slug mounted behind the shaped charge liner and the cylindrical slug may be connected to the cone of the liner or it may be placed some distance behind the cone along the axis of the charge.

Other objects, features and advantages of the invention will be readily apparent from the following description of certain preferred embodiments thereof taken in conjunction with the accompanying drawings although variations and modifications may be effected without departing the spirit and scope of the novel concept of the disclosure, and in which:

DESCRIPTION OF THE PREFERRED EMBODIMENTS

Figure 1:
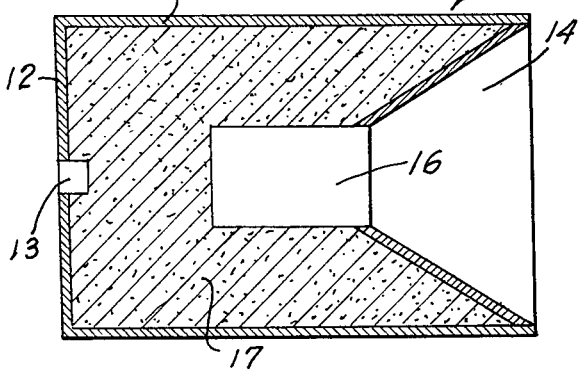
FIG. 1 is sectional view of the shaped charge device according to this invention before detonation.

FIG. 1 illustrates a shaped charge liner 10 comprising a cylindrical outer case 11. The rear end of the liner 11 is covered by a cover plate 12 in which is mounted a detonator 13. The forward end of the liner 11 is closed by a conical shaped charge liner 14. A cylindrical slug 16 is attached to the apex of the cone liner 14 and extends into the confines of the case 11.

The cylindrical slug 16 may be of incendiary material as for example may be constructed of misch metal.

Figure 3:
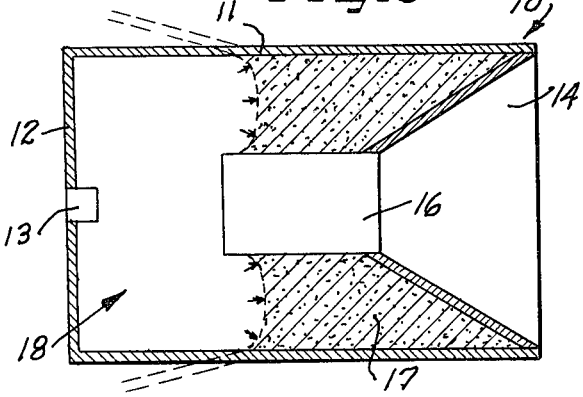
FIG. 3 is a sectional view of the shaped charge device later in time than FIG. 2.
Figure 2:
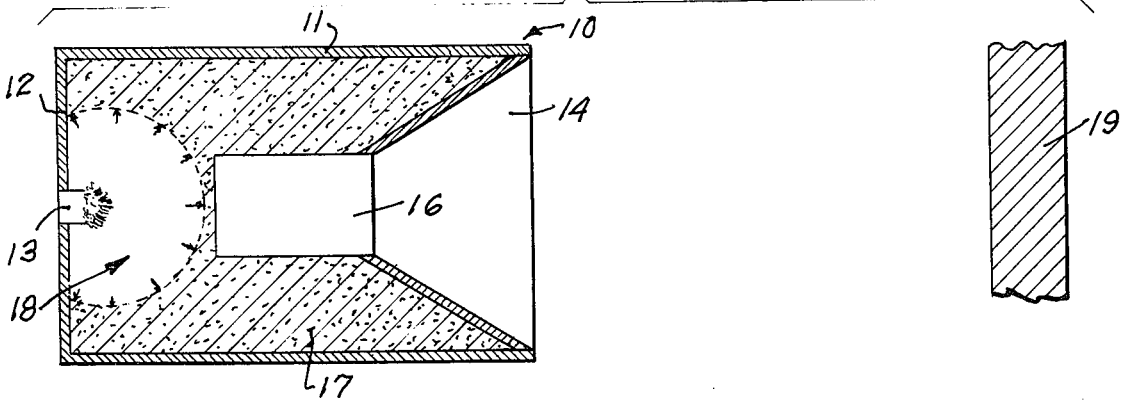
FIG. 2 is a sectional view of the shaped charge device of this invention after detonation.

In operation, the detonator 13 ignites the charge 17 in an area adjacent to the detonator 13 at a time when the shaped charge is positioned at a predetermined distance from the target 19 as shown in FIG. 2. FIG. 2 illustrates the expanding gas 18 of the charge 17 demonstrating the initial propagation of the detonation wave through the explosive charge. FIG. 3 is a view subsequent in time to that of FIG. 2 and illustrates the detonation wave of the burning charge 18 when it has passed the inner end of the cylindrical follow-through agent 16.

Figure 4:
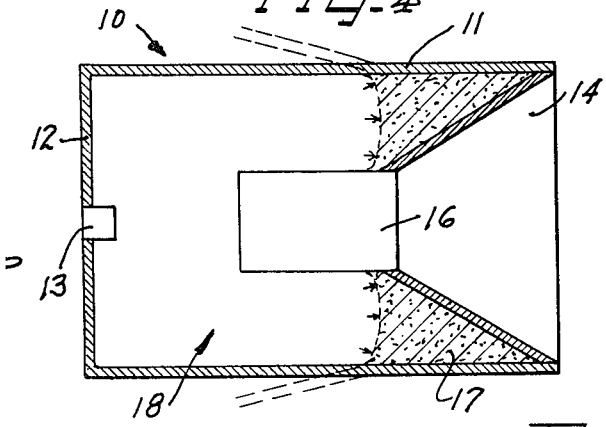
FIG. 4 is a sectional view of the shaped charge device later in time than FIG. 3.

FIG. 4 illustrates the device at a time subsequent to FIG. 3 wherein the detonation wave has propagated to a point just prior to impingement on the shaped charge liner 14.

Figure 5:
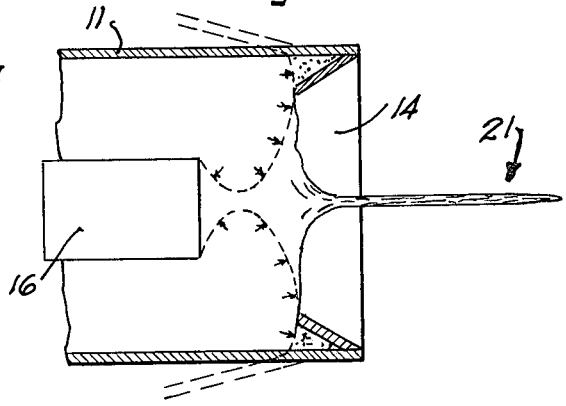
FIG. 5 is a partial sectional view of the shaped charge device of the invention later in time than FIG. 4.

FIG. 5 is a partially cutaway view illustrating the shaped charge liner 14 in the process of being collapsed to start the high velocity target perforating jet 21 toward the target 19 as shown in FIG. 2.

Figure 6:
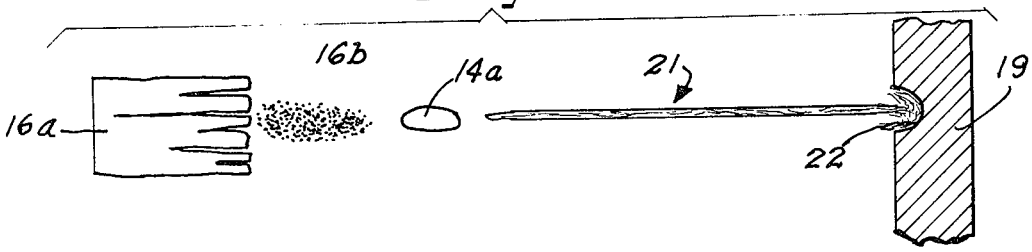
FIG. 6 is a plan view illustrating the shaped charge impinging on a target wall.

FIG. 6 is a side view with the shaped charge jet fully formed and with the jet 21 starting to penetrate the target 19 by the formation of an orifice 22. Part of the liner 14 has been formed, into a slug **14*a* and the follow-through agent 16 is fracturing and starting to follow the jet forward toward the target. The follow-through charge comprises the particles 16*b* and the fracturing remaining portion 16*a***.

It is to be noted in FIG. 3 that the detonation wave has started to flatten at this point in time so as to provide a more suitable shape for impingement on the shaped charge liner 14.

Figure 7:
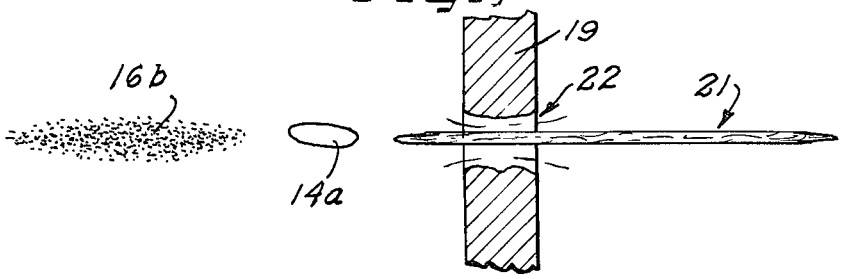
FIG. 7 is a plan view of the high velocity gases of the shaped charge of this invention penetrating a target wall.

In FIG. 6 the shaped charge jet 21 has been completely formed and the incendiary material **16*b* is following the jet 21 and the slug 14*a*. In FIG. 7 the high speed jet 21 has perforated the target 19 to form the orifice 22 and the slug 14*a* and the incendiary material 16*b* are following the jet and will pass through the orifice 22. It should be realized, of course, that if the target 19 comprises the wall of a tank or other enclosure, the slug 14*a* and the incendiary 16*b*** will be introduced into the inside of the target to thus introduce large quantities of incendiary, combustible or noxious material into the target which has been perforated by the projected liner material.

Figure 8:
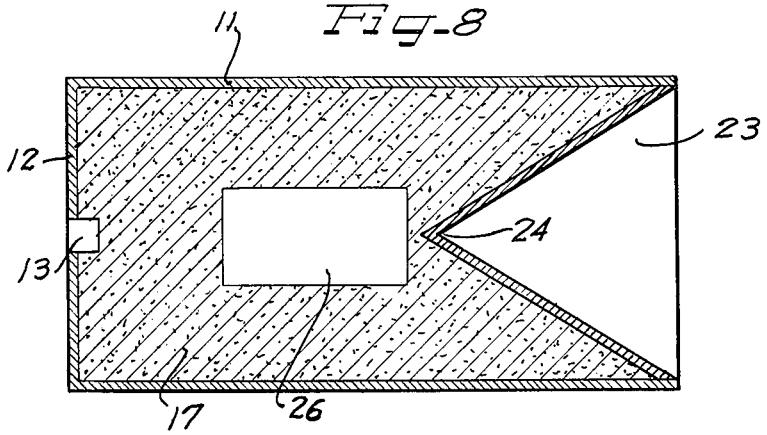
FIG. 8 is a sectional view of a modificaton of the invention.

FIG. 8 is a sectional view of a modification of the invention illustrating a cylindrical case 11 which has an end 12 with a detonator 13 which contains explosive charge 17 and which has a conical liner 23 with an apex 24 extending into the case 11. The follow-through agent 26 is of generally cylindrical shape and this embodiment is placed on the center axis of the case 11 but rearwardly of the apex 24 of the liner 23. Highly successful results are obtained with the modified structure of FIG. 8 as well as the embodiment illustrated in FIG. 1. The cylindrical follow-through charge 16 or 26 not only provides the function of serving as an incendiary which passes through the orifice 22 formed in the target wall, but it also aids in forming the detonation wave and shapes it so as to provide increased efficiency.

The forward movement of the incendiary material is caused by the force induced by the high pressure explosive products to the rear of incendiary slug 16 or 26.

The following parameters affect conical shaped charge performance:

| | |
|---|---|
| Charge Diameter D | Cone Angle $\alpha$ |
| Charge Shape | Initiation Point $i$ |
| Explosive Type E | Confinement |
| Explosive Head Height H * | Precision |
| Liner Shape | Standoff S |
| Liner Material | Delivery Conditions |
| Liner Thickness f | |

Additional parameters for Shaped Charge with an Incendiary Follow-Through Slug are:

| | |
|---|---|
| Incendiary Material | Slug Diameter d |
| Slug Location | Slug Length $L$ |

Figure 9:
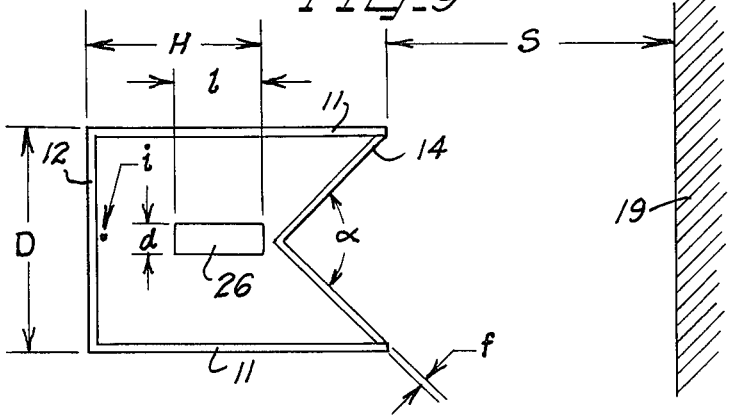
FIG. 9 is a sectional view of the invention illustrating various parameters of the system.

These parameters are shown as dimensions in FIG. 9.

Several charge diameters were selected for tests conducted with this invention.

The charge shape was selected as a simple cylindrical shape in tests run with this invention.

The explosive used in testing this invention was Composition C-4.

The wave shaper located at the liner apex of a short head height conical shaped charge will increase the performance of that munition. The height of explosive between the detonator and the slug will greatly influence the forward motion of the slug.

Standoff: Standoff is the distance between the shaped charge liner and the target at the time of detonation which substantially affects shaped charge as is shown by the attached graph FIG. 11.

Liner Shape: The simple conical liner was used in tests of the invention.

Liner Material: A steel or copper liner will produce a deep, rather small diameter hole in concrete while a glass liner will produce a hole which is shallower but generally larger in diameter. This would mean that more incendiary mass could be expected to enter a thin concrete target if a glass liner were used. Specific liner materials can be selected for the tactical role of the munition under consideration, and in the present invention for test purposes liners of mild steel and cooper were utilized.

Figure 11:
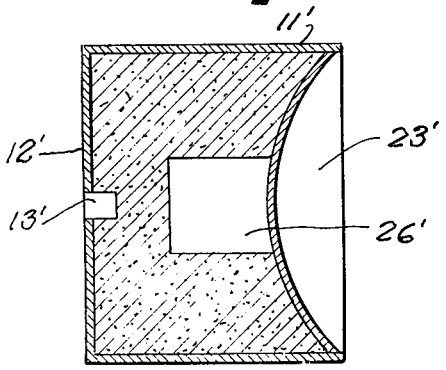

The Liner Cone Angle: The liner cone angle of a shaped charge has a definite effect upon penetration, hole volume and hole profile. As shown by FIG. 11 the dependence of penetration on cone angle for a particular charge design is illustrated.

Liner Thickness: Liner thickness and uniformity have a direct influence on hole profile which in turn will have an effect upon the amount of follow-through mass entering the target. Since there is a direct relationship between the liner cone angle and thickness, optimum or near optimum thickness was used in testing the invention.

Initiation Point: Testing was accomplished with initiation utilizing a No. 6 or No. 8 blasting cap located at the aft end of the shaped charge directly in line with the projected apex of the liner.

Confinement: Lateral confinement affects the shaped charge performance and also influences the axial velocity of the incendiary material. This is due to the increase in axial momentum caused by lateral restraint of the gases generated by the explosion. Tests were conducted utilizing fabricated steel tubing.

Precision: The effects of precision on shaped charge performances are particularly important for charges less than three inches in diameter.

Incendiary Material: The physical properties of the incendiary have a direct effect upon the incendiary effectiveness of the shaped charge. For example, if the density of the incendiary is increased, the average forward velocity of the incendiary material is reduced due to the decrease in charge-to-mass ratio along the axis of the charge. Other physical properties also affect the incendiary input. Solid incendiary materials, such as wrought zirconium, which can survive the compression by explosive pressures, can be projected through the perforation without ignition. Breakup of some pyrophoric materials is necessary to achieve incendiary effects. Various materials can be used as the incendiary follow-through agent such as zirconium, titanium, Magnesium-Teflon(R) and a wide variety of misch metals. A misch metal such as Ceralloy 100X(R) available from Ronson Metals Corporation of Newark, New Jersey, is particularly advantageous.

Incendiary Slug Location: By properly locating the cylinder of follow-through material behind the apex of the cone, penetration can be increased as much as 20 percent. Tests have shown that no degradation of performance occurs if a cylinder of incendiary is placed in contact with a shaped charge liner.

Incendiary Slug Diameter: The slug diameter is an important parameter since it has an effect on wave shaping, the quantity of material in the slug, and the amount of explosive displaced. The penetrating ability increases with the diameter of the slug until the ratio of the slug diameter to the explosive charge diameter is approximately 1 to 3.

Incendiary Slug Length: Incendiary slug length is an important parameter due to its effect upon performance due to wave shaping and also the amount of incendiary present for a given slug diameter.

Delivery Conditions: The projected incendiary particles will occupy a conically expanding region. The apex angle of this cone of dispersing particles must pass through the hole produced by the shaped charge jet. If the munition possesses a forward velocity at the time of detonation, this forward velocity component will be transmitted to the particles, thereby reducing the apex angle of the cone of dispersion. At the same time, any rotation of the munition at the time of detonation will induce radial velocity to the incendiary particles thus increasing the apex angle of the cone of dispersion.

Figure 10:
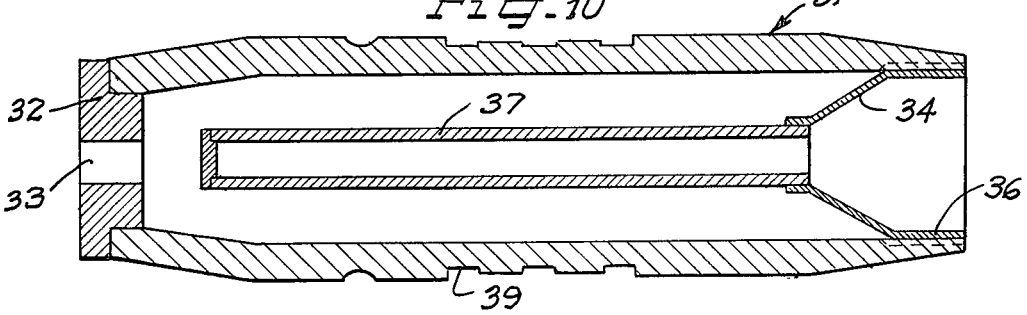
FIGS. 10 and 11 are sectional views of practical embodiments of the invention.
Figure 12:
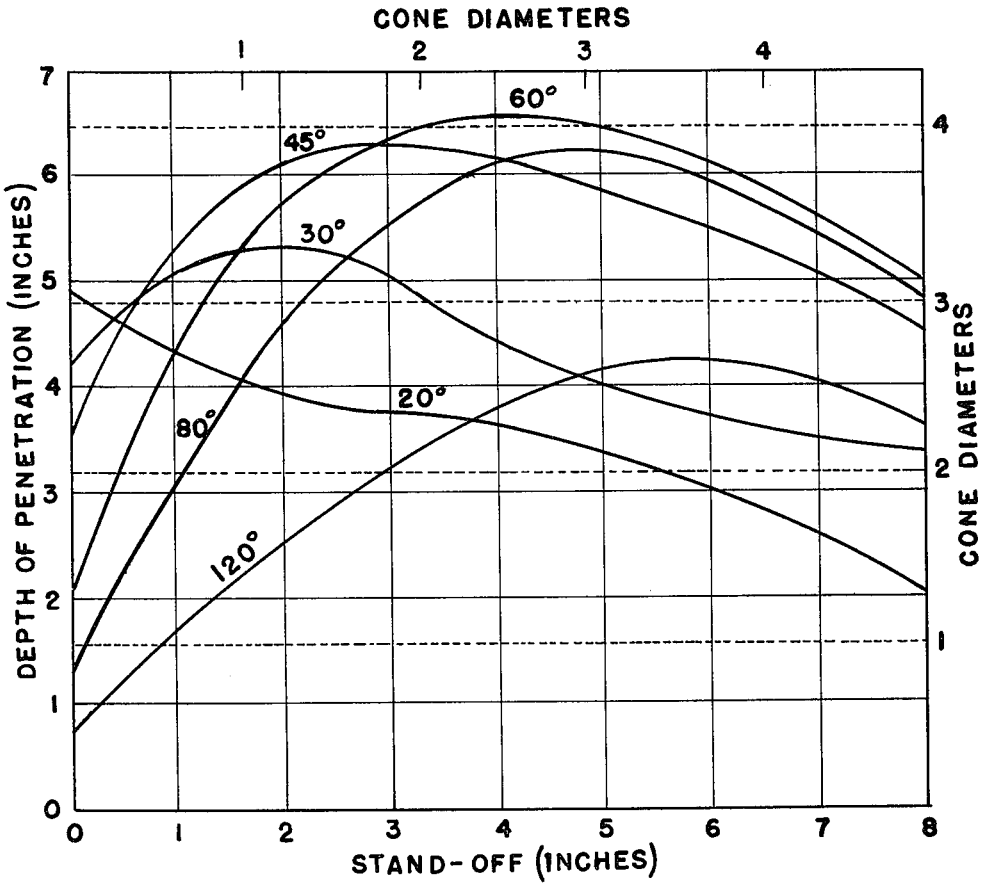
FIG. 12 is a graph showing the effect of varying parameters.

FIG. 10 illustrates a shaped charge device comprising the case 31 which has a seat for a rotating band 39 in its outer surface and an end 32 in which a detonator 33 is mounted. A liner 34 of conical shape has a cylindrical portion 36 attached to the end of the casing 31 opposite the detonator 33. Cylindrical spitback tube 37 is a hollow incendiary slug and may be made of zirconium, for example.

FIG. 11 illustrates another application of this invention. It differs from other examples by utilizing a non-conical shaped charge liner. In this case a section of a sphere is used.

It is seen that this invention provides an improved shaped charge device and although it has been described with respect to preferred embodiments it is not to be so limited, as changes and modifications may be effected which are within the full intended scope of the invention as defined by the appended claims.

I claim as my invention:

1. A shaped charge device providing follow-through of material comprising a generally cylindrical case formed with a rear end wall, a shaped charge forming liner mounted in the front end of said case, a solid cylindrical shaped body of follow-through material consisting of zirconium, titanium, Magnesium-Teflon or misch metals mounted on the longitudinal axis of said case between said rear end wall and said shaped charge forming liner, explosive material filling the remaining space of said case, detonating means mounted in said case for detonating said explosive in a region near said rear wall, and wherein said shaped charge forming liner is conical in shape and mounted so as to extend inwardly and symmetrically with respect to said case and the apex of said conical liner is truncated and forming an opening into which said body of follow-through material is received such that the liner and follow-through material form an integral shaped charge forming structure.

2. A shaped charge device providing follow-through of material comprising a generally cylindrical case formed with a rear end wall, a shaped charge forming liner mounted in the front end of said case, a solid cylindrical shaped body of follow-through material consisting of zirconium, titanium, Magnesium-Teflon or misch metals mounted on the longitudinal axis of said case between said rear end wall and said shaped charge forming liner, explosive material filling the remaining space of said case, detonating means mounted in said case for detonating said explosive in a region near said rear end wall, and wherein said follow-through material is incendiary.

3. A shaped charge device providing follow-through of material comprising a generally cylindrical case formed with a rear end wall, a shaped charge forming liner mounted in the front end of said case, a solid cylindrical shaped body of follow-through material consisting of zirconium, titanium, Magnesium-Teflon or misch metals mounted on the longitudinal axis of said case between said rear end wall and said shaped charge forming liner, explosive material filling the remaining space of said case, detonating means mounted in said case detonating said explosive in a region near said rear end wall, and wherein said shaped charge liner is symmetrical about the longitudinal axis and is a section of a sphere.

* * * * *